United States Patent [19]

Wrede

[11] Patent Number: 4,758,216

[45] Date of Patent: Jul. 19, 1988

[54] BOWL FOR A CENTRIFUGE FOR CLARIFYING OR SEPARATING MIXTURES OF LIQUIDS

[75] Inventor: Ulrich Wrede, Ennigerloh-Ostenfelde, Fed. Rep. of Germany

[73] Assignee: Westfalia Separator Aktiengesellschaft, Oelde, Fed. Rep. of Germany

[21] Appl. No.: 17,514

[22] Filed: Feb. 24, 1987

[30] Foreign Application Priority Data

Feb. 28, 1986 [DE] Fed. Rep. of Germany ..... 3606522

[51] Int. Cl.[4] ..... B04B 7/08

[52] U.S. Cl. ..... 494/40; 494/84

[58] Field of Search ..... 494/40, 56, 84, 27; 210/781, 360.1; 137/58, 53, 38

[56] References Cited

U.S. PATENT DOCUMENTS

| | | | |
|---|---|---|---|
| 3,250,463 | 5/1966 | Thylefors | 494/40 X |
| 4,036,428 | 7/1977 | Durland | 494/84 X |
| 4,392,845 | 7/1983 | Gunnewig | 494/56 X |
| 4,479,788 | 10/1984 | Kohlstette | 494/27 |
| 4,498,987 | 2/1985 | Günnewig | 494/40 X |
| 4,636,319 | 1/1987 | Stroucken | 210/781 |
| 4,645,485 | 2/1987 | Niemerg | 494/27 |
| 4,695,270 | 9/1987 | Zettier | 210/360.1 X |

*Primary Examiner*—Harvey C. Hornsby
*Assistant Examiner*—Kim L. O'Leary
*Attorney, Agent, or Firm*—Sprung Horn Kramer & Woods

[57] ABSTRACT

A bowl for a centrifuge for clarifying or separating mixtures of liquids. The bowl has a valve or slide that is maintained in the closure position by a closure fluid. The closure fluid circulates at the same angular velocity as the bowl. A closure chamber containing the closure fluid is associated with the bowl. To decrease the consumption of closure fluid, the opening motion of the valve or slide is initiated by closure fluids that act on the closure fluid in a direction opposite the one that the bowl is rotating in and that decrease the angular velocity of the closure fluid and hence the closure force exerted on the valve or slide while the bowl continues to rotate at full operating speed.

7 Claims, 3 Drawing Sheets

BOWL FOR A CENTRIFUGE FOR CLARIFYING OR SEPARATING MIXTURES OF LIQUIDS

BACKGROUND OF THE INVENTION

The present invention relates to a bowl for a centrifuge for clarifying or separating mixtures of liquids, with a valve or slide that is maintained in the closure position by a closure fluid, which circulates at the same angular velocity as the bowl, and that is associated with a closure chamber containing the closure fluid.

A centrifuge bowl of this type is known from U.S. Pat. No. 3,250,463. The extraction channels that extend in the jacket of the bowl from the solids space are closed off with a piston slide. A closure chamber that can be filled with closure fluid from a supply line is associated with the piston line. Runoff bores extend radially out from the closure chamber through the jacket of the bowl. Closure fluid always emerges from these bores while the piston slide is in the closure position, and the lost fluid must be replenished. The opening motion of the piston slide is initiated by adjusting the supply of closure fluid to the closure chamber, allowing the closure fluid in the closure chamber and supply line to flow out through the runoff bores subject to centrifugal force. To discontinue the opening motion of the piston slide, fluid is again introduced into the closure chamber through the supply line, generating a closure force in the closure chamber that shifts the piston slide into the closure position and maintains it there.

Since the closure chamber must be emptied to initiate the opening motion and filled with closure fluid again to initiate the closing motion of the piston slide, the known system of controls is relatively sluggish. Furthermore, since closure fluid must be constantly supplied to the closure chamber during the closure phase, more fluid has to be consumed.

SUMMARY OF THE INVENTION

The object of the present invention is to improve a centrifuge bowl of the type initially described to the extent that it is simple in design and consumes little closure fluid.

This object is attained in accordance with the invention by the improvement wherein the opening motion of the valve or slide is initiated by means that act on the closure fluid in a direction opposite the one that the bowl is rotating in and that decreases the angular velocity of the closure field and hence the closure force exerted on the valve or slide while the bowl continues to rotate at full operating speed.

The velocity of the valve or slide, however, is very high during the opening and closing phases.

The means of initiating the opening motion of the valve or slide by decreasing the angular velocity of the closure fluid in one embodiment of the invention can be introduced into the closure chamber or activated from outside.

The means of decreasing the angular velocity of the closure fluid in the closure chamber in one practical embodiment of the invention is closure fluid that is introduced into the closure chamber in a direction opposite the one that the bowl is rotating in and that forces a corresponding volume of closure fluid out of the closure chamber.

The closure chamber can be divided by a radial sluice into two spaces that communicate through an overflow, with nozzles that can be charged with closure fluid emptying into one space that faces the valve or slide, and the other space being provided with runoff channels that extend outward.

In another embodiment, the closure chamber can have a ring that can be braked. The ring can have radial vanes distributed around it and can be made out of a magnetizable material, the bowl can be made out of non-magnetizable material, and a magnet that can be activated and deactivated can be positioned outside the bowl in the vicinity of the closure chamber.

When the closure chamber is accessible from outside, a braking component can be introduced into it.

The closure force that is generated subject to the centrifugal forces occurring when the bowl is in operation and that act on the valve or slide depends on the angular velocity of the closure fluid. Since the relation between the closure fluid and the angular velocity is quadratic, small variations in the angular velocity are sufficient to result in great changes in the closure force. Decreasing the angular velocity of the closure fluid in accordance with the invention accordingly results in a rapid and controlled emptying of the centrifuge bowl. It is unnecessary to empty the closure chamber to initiate the opening motion of the valve or slide.

Some preferred embodiments of the invention will now be specified with reference to the attached drawings, wherein:

DETAILED DESCRIPTION OF THE PREFERRED EMBODIMENTS

Figure 1:
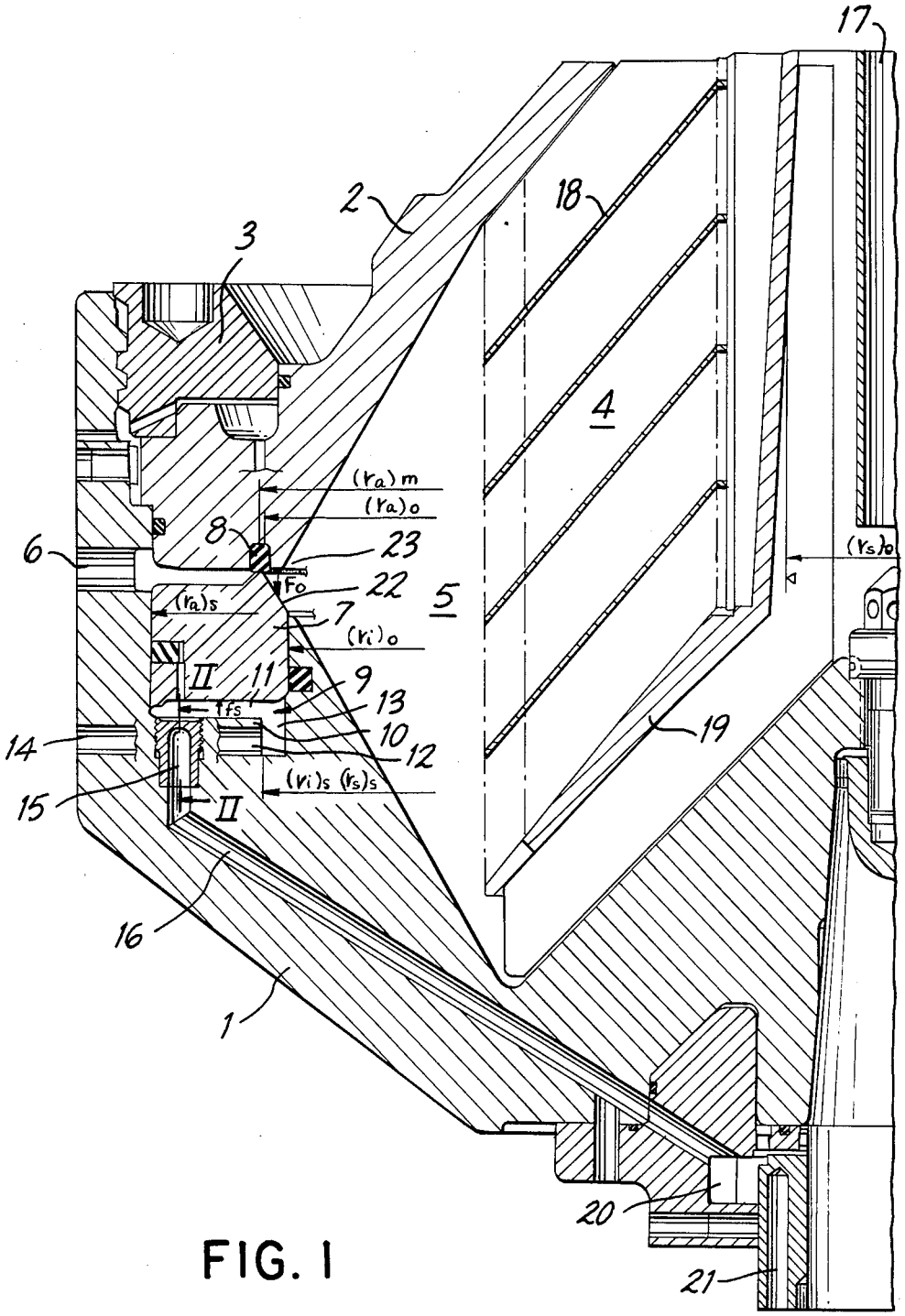
FIG. 1 is a vertical section through the bowl of a self-emptying centrifuge according to the invention.

The centrifuge bowl illustrated in FIG. 1 has a bottom 1, a lid 2, and a closure ring 3 that fastens the two components together.

The centrifuging space of the bowl consists of a separation space 4 and a solids space 5. Extraction channels 6 in the jacket of the bowl extend radially outward from the solids space. Solids space 5 can be closed off from extraction channels 6 by a piston slide in the form of an annular piston 7 that operates in the closure position in conjunction with a seal 8 secured in a groove in lid 2. A closure chamber 9 is associated with annular piston 7. Closure chamber 9 is separated into two spaces 11 and 12 by a radial sluice 10. Spaces 11 and 12 communicate through an overflow 13. Runoff channels 14 extend out from space 12.

Figure 2:
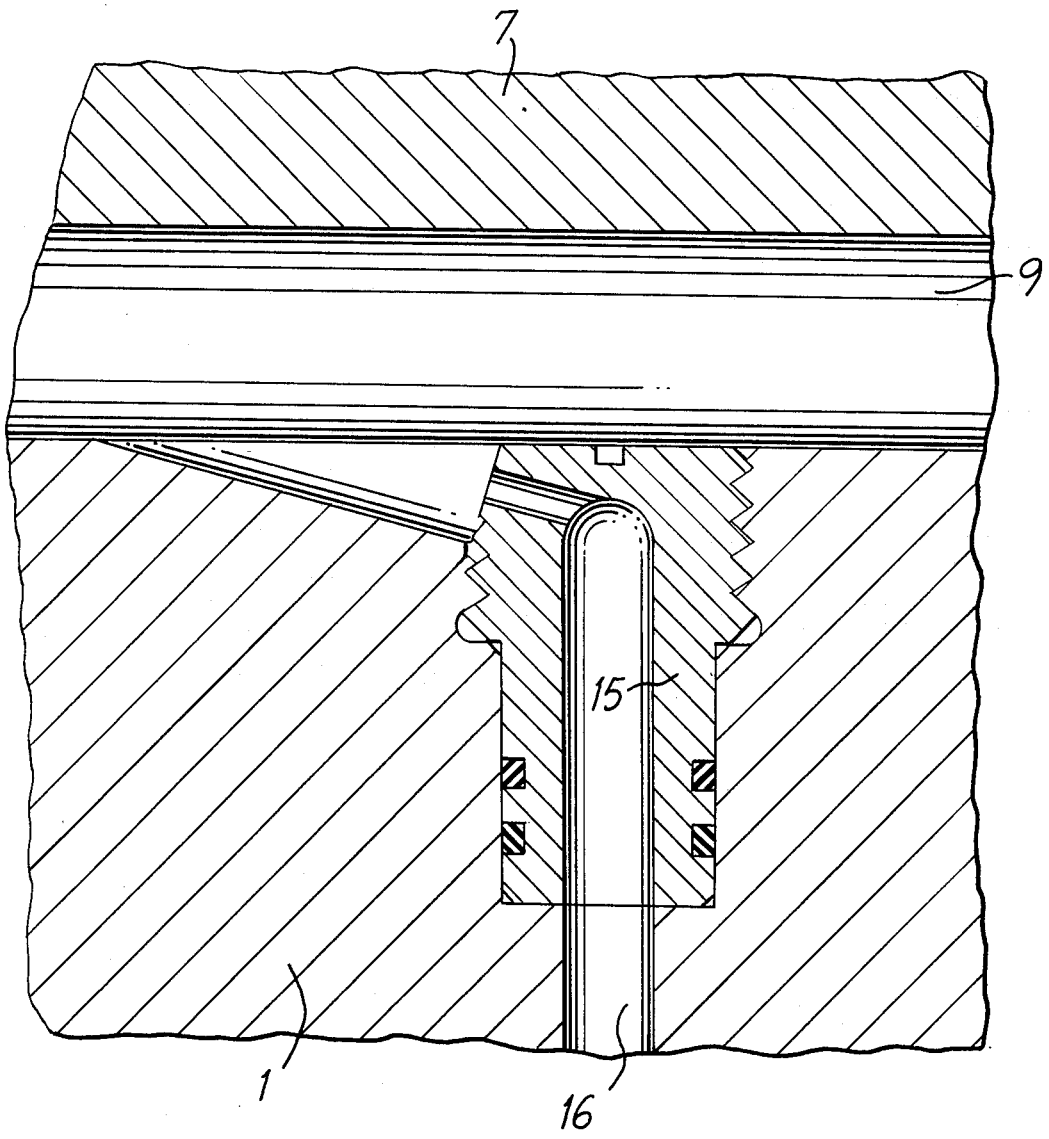
FIG. 2 is a section along the line II—II in FIG. 1.

Nozzles 15 empty into the space 11 in closure chamber 9. Nozzles 15 can be charged with closure fluid. They point in the direction opposite the one that the bowl rotates in as can be seen in FIG. 2. Control fluid, preferably water, can be supplied to nozzles 15 through lines 16.

The mixture of liquids that is to be separated or clarified in the centrifuge is supplied through a central inflow pipe 17 and arrives in separation space 4. Separation space 4 accommodates a stack of conical plates 18 resting on a distributor 19.

The line 16 that supplies control fluid extends from a chamber 20, to which the fluid is supplied through a channel 21.

The object of the invention will now be specified with reference to the following calculations by way of example.

In plotting the force $F_S$ necessary to close annular piston 7, it is assumed that the column of liquid in the bowl extends to the overflow radius $(r_s)_o$ of the gripper. It accordingly acts on the annular surface 22 of annular piston 7 from the inner edge $(r_i)_o$ of the piston to the center $(r_a)_m$ of sealing surface 23. Let $$(r_s)_o = 0.035 \text{ m} \qquad \omega = 754 \text{ sec}^{-1}$$
$$(r_i)_o = 0.1935 \text{ m}$$
$$(r_a)_m = 0.201 \text{ m.}$$

The forces can be calculated from the equation $$F = \frac{g}{2} \cdot \omega^2 \cdot \pi \left[ \frac{(r_a)_n^4}{2} - \frac{(r_i)_o^4}{2} - (r_s)_o^2 \left((r_a)_m^2 - (r_i)_o^2\right) \right] \quad (1)$$

The maximal opening force is accordingly:

$$(F_o)_{(ra)m} = 99\,603 \; N$$

To shift annular piston 7 into the closure position and maintain it there:

$$F_S \geqq (F_o)_{(r_a)_m} \quad (2)$$

The column of liquid that can be exploited for closure acts from the inner edge $(r_s)_s = (r_i)_s$ of sluice 10 to the outer edge $(r_a)_s$ of annular piston 7. Let $$(r_s)_s = 0.2 \text{ m} \qquad \omega = 754 \text{ s}^{-1}$$
$$(r_i)_s = 0.2 \text{ m}$$
$$(r_a)_s = 0.235 \text{ m.}$$

Equation (1) yields a closure force of $F_S = 103{,}502$ N. This means that Equation (2) is satisfied and the centrifuge bowl is closed.

When closure chamber 9 is full and the bowl empty, the maximal pressure on seal 8 will be $$p = \frac{F_s}{\frac{\pi}{4}(d_o^2 - d_i^2)} \quad (3)$$

Here $d_a$ is the outside diameter of sealing surface 11 and $d_i$ the inside diameter of sealing surface 10:

$$d_a = 0.404 \; m$$
$$d_i = 0.4 \; m$$
$$p = 4098 \; N/cm^2.$$

To ensure reliable opening it is assumed that the available opening force acts only as far as the inner edge $(r_a)_o$ of sealing surface 23:

$$(r_s)_o = 0.035\text{m} \qquad \omega = 754 \text{ m}^{-1}$$
$$(r_i)_o = 0.1935 \text{ m}$$
$$(r_a)_o = 0.2 \text{ m}$$

Thus, from Equation (1):

$$F_o = 85{,}646 \; N.$$

To open the bowl the closure force must be lower than opening force: $F_S < F_O$.

The maximal peripheral velocity in closure chamber 9 is $$V_T = \frac{d \cdot \pi \cdot n}{60} \quad (4)$$

The outside of the diameter of closure chamber 9 is employed for d:

$$d = 2\,(r_a)_s$$
$$d = 0.47 \text{ m} \qquad n = 7200 \text{ min}^{-1}$$
$$V_T = 177 \text{ m/sec.}$$

The attainable pressure at the outflow from deflection nozzles 15 yields the maximal outflow velocity $V_F$:

$$\Delta p = \frac{g}{2} \omega^2 (r_1^2 - r_2^2) \quad (5)$$

$$V_F = \sqrt{\frac{2 \cdot \Delta p}{g}} \quad (6)$$

The pressure depends on the effective level of fluid in control-fluid lines 16.

Let $r_2$ be the outer edge of control-fluid chamber 20. Then, $r_1$ will be the inner edge of sluice 10:

$$r_1 = 0.2 \text{ m} \qquad \omega = 754 \text{ sec}^{-1}$$
$$r_2 = 0.06 \text{ m.}$$

Under these assumptions a differential pressure $\Delta p$ can be calculated from Equation (5):

$$\Delta p = 103.5 \text{ bars.}$$

The outflow velocity calculated from Equation (6) naturally ignores flow losses.

$$V_F = 144 \; (m/s)$$

Comparison of $V_T$ and $V_F$ will show that in spite of some losses in the channel the closure fluid can be satisfactorily decelerated when braked.

Decreasing the angular velocity of the closure fluid by 25% will result in the following values for the emptying process:

$$\omega_{(75\%)} = \frac{\omega \cdot 75}{100} \quad (7)$$

$$\omega_{(75\%)} = 565.5 \text{ s}^{-1}$$

The closure force at an angular velocity decreased 75% is:

$$(F_s)_{\omega(75\%)} = 58220 \; N < F_o = 85646 N$$

$$(F_o - (F_s)_{\omega(75\%)} = 27426 N)$$

The closure phase is initiated when the closure and opening forces are in equilibrium again. The associated level of liquid in the bowl is computed from Equation (8):

$$(r_s)_s = \sqrt{\frac{\frac{(r_a)_s^4}{2} - \frac{(r_i)_s^4}{2} - \frac{2\,(F_s)_{\omega(75\%)}}{g \cdot \omega^2 \cdot \pi}}{((r_a)_s^2 - (r_i)_s^2)}} \quad (8)$$

$$(r_s)_s = 0.115 \text{ m}$$

The speed $V_A$ of the fluid flowing out of deflection nozzles 15 in the direction opposite the one that the bowl is turning in decreases the angular velocity of the closure fluid acting on annular piston 7. This leads to partial or complete emptying of solids space 5 down to equilibrium level, which corresponds to the decreased angular velocity.

The decelerated closure fluid in closure chamber 9 is partly forced out when the bowl is opened and is removed without being choked off over sluice 10 and radial runoff channels 14.

Rapid closure of annular piston 7 is ensured because the volume of closure fluid forced out during the opening process will be completely replenished by the large volume of water introduced during the closure process.

Figure 3:
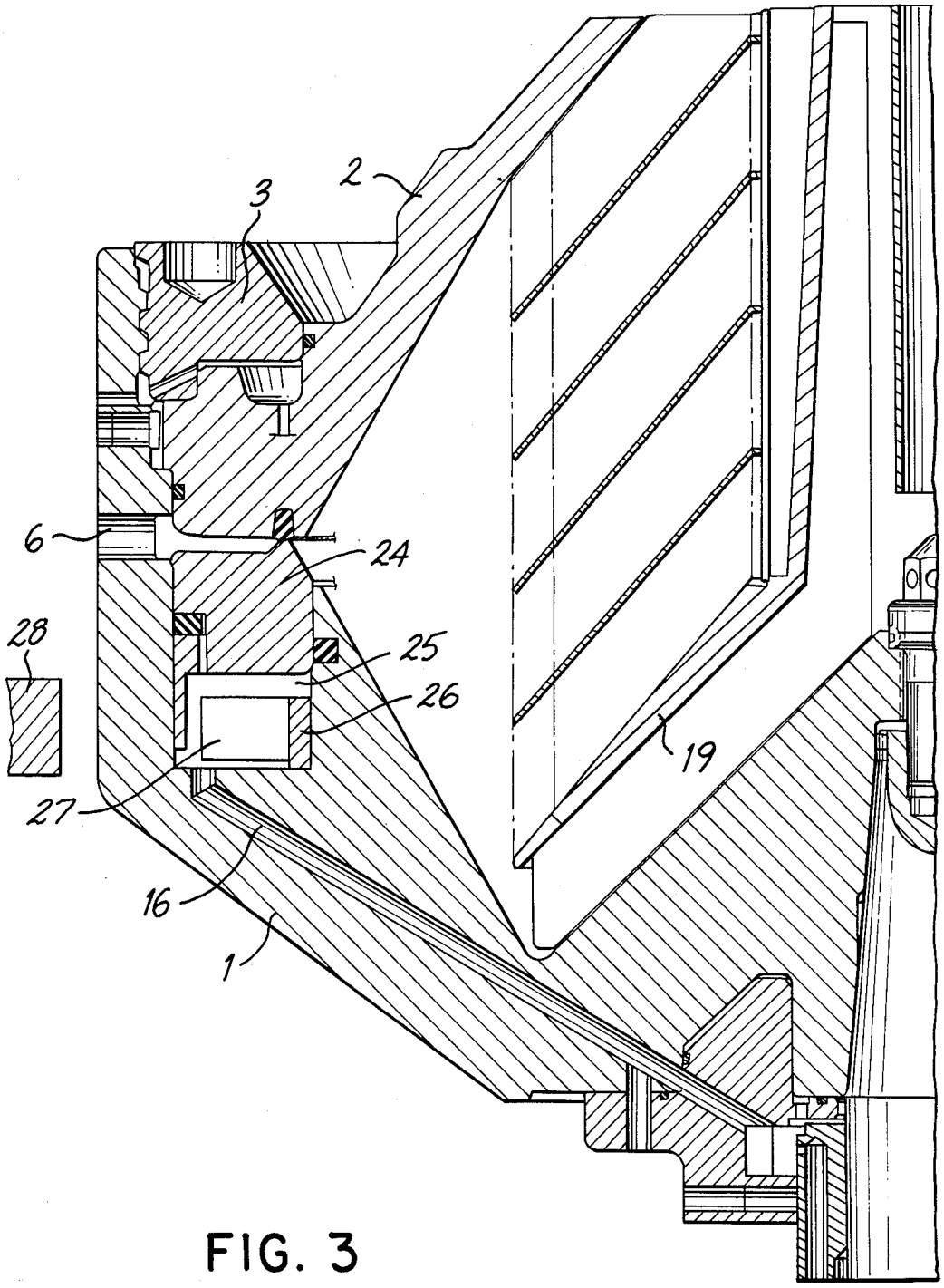
FIG. 3 is a vertical section through another embodiment of the bowl according to the present invention.

The closure chamber 25 associated with the annular piston 24 in the embodiment of a bowl illustrated in FIG. 3 contains a ring 26. Radial vanes 27 are distributed around the circumference of ring 26. The ring is made out of a magnetizable material and the bowl out of a non-magnetizable material. A magnet 28 that can be activated and deactivated is positioned outside the bowl and in the vicinity of the closure chamber.

Activating magnet 28 brakes ring 26, decreasing the angular velocity of the closure fluid and reducing the closure force that acts on annular piston 24.

When the closure chamber is accessible from outside, a braking component can also be introduced into the chamber to decrease the angular velocity of the closure fluid.

It will be appreciated that the instant specification and claims are set forth by way of illustration and not limitation, and that various modifications and changes may be made without departing from the spirit and scope of the present invention.

What is claimed is:

1. In a bowl for a centrifuge for clarifying or separating mixtures of liquids, with extraction channels, means movable between a closure position and an opening position for closing off and opening up the extraction channels, a closure chamber and closure fluid contained in the closure chamber for maintaining the movable means in the closure position and which circulates at the same angular velocity as the bowl, the improvement comprising means for acting on the closure fluid in a direction opposite the one that the bowl is rotating in to decrease the angular velocity of the closure fluid thereby decrease the closure force exerted on the movable means while the bowl continues to rotate at full operating speed, whereby movement from the closure position to the opening position is initiated.

2. The bowl as in claim 1, wherein the means for acting on the closure fluid includes means acting on the closure fluid in the closure chamber.

3. The bowl as in claim 1, wherein the means for acting on the closure fluid comprises means for introducing closure fluid into the closure chamber in a direction opposite the one that the bowl is rotating in to force a corresponding volume of closure fluid out of the closure chamber.

4. The bowl as in claim 3, further comprising a radial sluice dividing the closure chamber into two spaces that communicate through an overflow and wherein the means for introducing closure fluid includes nozzles chargeable with closure fluid and emptying into one space facing the movable means, and run-off channels in communication with the other space extending outward.

5. The bowl as in claim 1, wherein the means acting on the closure fluid comprises a ring in the closure chamber.

6. The bowl as in claim 5, wherein the ring has radial vanes distributed around it and is composed of a magnetizable material, wherein the bowl is composed of non-magnetizable material, and the braking means comprises activatable magnet positioned outside the bowl in the vicinity of the closure chamber.

7. The bowl as in claim 1, wherein the closure chamber is accessible from outside the bowl and the means acting on the closure fluid comprises means for introducing a braking component into the closure chamber.

* * * * *

UNITED STATES PATENT AND TRADEMARK OFFICE

CERTIFICATE OF CORRECTION

PATENT NO. : 4,758,216

DATED : Jul. 19, 1988

INVENTOR(S) : Wrede

It is certified that error appears in the above-identified patent and that said Letters Patent is hereby corrected as shown below:

| | |
|---|---|
| Title Page, under "U.S. Patent Documents", line 5 | Correct Document Number --4,498,897-- |
| Col. 3, line 20 | Correct formula -- $F = \frac{g}{2} \cdot \omega^2 \cdot \pi \left[ \frac{(r_a)^4_m}{2} - \frac{(r_i)^4_o}{2} - (r_s)^2_o \left( (r_a)^2_m - (r_i)^2_o \right) \right]$ -- |

Signed and Sealed this

Twenty-eighth Day of February, 1989

*Attest:*

DONALD J. QUIGG

*Attesting Officer*

*Commissioner of Patents and Trademarks*